US005348278A

United States Patent [19]

Ring

[11] Patent Number: 5,348,278

[45] Date of Patent: Sep. 20, 1994

[54] PAPER WEB SEPARATOR AND GUIDING APPARATUS

[75] Inventor: Robert S. Ring, Rochester, N.H.

[73] Assignee: Moore Business Forms, Inc., Grand Island, N.Y.

[21] Appl. No.: 18,302

[22] Filed: Feb. 16, 1993

[51] Int. Cl.[5] ..... B65H 39/06

[52] U.S. Cl. ..... 270/52; 270/52.5

[58] Field of Search ..... 270/10, 52.5, 52, 32, 270/43, 4; 226/197, 199; 242/56.2

[56] References Cited

U.S. PATENT DOCUMENTS

| | | | |
|---|---|---|---|
| 263,750 | 9/1882 | Anthony et al. | 270/52 |
| 655,355 | 8/1900 | Scott | 270/10 X |
| 818,655 | 4/1906 | Balze | 270/52 |
| 1,161,476 | 11/1915 | Hoe | 270/5 |
| 1,348,553 | 8/1920 | Dowell | 226/197 X |
| 1,790,559 | 1/1931 | Swift, Jr. . | |
| 2,214,593 | 9/1940 | Mustin et al. | 270/52 |
| 2,619,057 | 11/1952 | Ellis, Sr. . | |
| 2,868,539 | 1/1959 | Koons et al. | 270/52 X |
| 3,399,884 | 9/1968 | Bahrani | 270/52 |
| 3,556,509 | 1/1971 | Crum | 270/52 |
| 3,734,487 | 5/1973 | Treff | 270/52 |
| 3,889,345 | 6/1975 | Hirschberg | 226/197 X |
| 4,179,109 | 12/1979 | Harris | 270/52 |
| 4,474,566 | 10/1984 | Meadows et al. . | |
| 5,016,801 | 5/1991 | Gilat et al. | 226/197 |
| 5,100,117 | 3/1992 | Hajek et al. | 270/52 |
| 5,104,104 | 4/1992 | Mol | 270/52 X |

FOREIGN PATENT DOCUMENTS

| | | | |
|---|---|---|---|
| 55-66458 | 5/1980 | Japan | 270/10 |

*Primary Examiner*—Edward K. Look
*Assistant Examiner*—John Ryznic
*Attorney, Agent, or Firm*—Nixon & Vanderhye

[57] ABSTRACT

A compact interstacking web deflector for causing a split paper web to overlap one side of the web over the other. The web deflector includes a triangular support plate over which the split web flows. The triangular leading edge of the support plate includes a pair of rods angled with respect to the paper webs. As the paper webs flow over the respective rods, opposing twists are imparted to the side-by-side sections of the paper web that causes the web sections to merge towards the centerline of the deflector. The twists in the web sections are removed as the sections loop under a pair of free-floating tension tubes. In this manner, the paper webs are superimposed one over the other for subsequent processing.

11 Claims, 4 Drawing Sheets

PAPER WEB SEPARATOR AND GUIDING APPARATUS

TECHNICAL FIELD

The invention relates to web separation and stacking devices. In particular, the invention relates to an interstacking device that separates side-by-side sections of a web and superimposes these sections one over the other.

DESCRIPTION OF THE RELATED ART

Some paper webs are printed in multiple longitudinal sections. For example, front and back sheets of a mailer envelope may be printed side by side on a single web. Similarly, duplicate copies of a business form may be printed adjacent each other on a web. At some point in the processing of the mailer and business form, the side-by-side sections of the web are separated and superimposed one on top of the other. In particular, the adjacent front and back sections of the envelope are split longitudinally and superimposed together so that the front and back of the envelope can be sealed together. Similarly, the side-by-side business forms are split and superimposed together to form a carbonless multiple copy form.

In the past it has proven problematic to split a web longitudinally, separate the adjacent web sections, and superimpose the two sections. Splitting the web presents few difficulties, but superimposing the slit web sections is difficult. Once the web is split along its centerline, the two sections are separated and twisted to move one section over the other. Once the sections have been aligned one over the other, the webs are again twisted bring them back together in an overlying relationship. The twisted webs are difficult to handle and often cause the webs to wrinkle. Wrinkles cause a web to jam in automatic web processing devices. Moreover, tension control on the two twisting webs is often less than satisfactory resulting in tearing and jamming of the webs.

Prior techniques for splitting and stacking side-by-side paper web sections require rollers spaced relatively large distances apart from the other sections of the web handling apparatus. For example, U.S. Pat. No. 2,214,593, entitled "Paper Registering Mechanism" describes skewed deflecting rollers that twist the side-by-side paper webs into a superimposed relationship. Traditionally the vertical gap required by the rollers to twist the webs into alignment has been about four to five feet. In addition, the rollers could superimpose just one side of the web over the other, such as the left side over right, but not right side over the left. The prior art deflection rollers lacked the flexibility to superimpose either right sections over left or left sections over right.

The twists imparted to the webs in the traditional deflecting rollers caused difficulties at the upstream web slitter device and downstream buster device that stacks the superimposed web sections. Twists in the web had a tendency to cause the webs to drift off the tractor feeder devices in the splitter and buster. Prior deflecting rollers were less than satisfactory in requiring large amounts of space, their inability to switch the side of the web that was to overlay the other side, and their tendency to wrinkle the web and the jam web handling devices. There has been a long-felt, unsatisfied need for a compact interstacking web deflector that is reversible and does not cause the webs to wrinkle.

SUMMARY OF THE INVENTION

A web deflecting device has been invented to compactly bring a pair of adjacent sections of a slit web into superimposed registration. A triangular web deflection leading edge is positioned at the output of a web splitter. The split web slides downward over the web deflection edge. As the web sections flow over the triangular web deflection edge, the split web sections are twisted slightly in opposing directions.

The twist in the split web sections causes the web sections to move together one over the other as the web sections flow vertically downward from the web deflection edge. The twisted web sections loop down and under a pair of rollers that impart constant tension to each web loop. At the bottom of the loops the pair of web sections completely overlap with one web loop being cradled within the other loop.

In one embodiment of the invention, a web handling apparatus comprises a slitter merger receiving a web stock and slitting the web into longitudinal sections. The slitter merger has an outlet from which split sections of the web emerge and slide over the edge of an interstacking web deflector. The triangular leading edges of the web deflector are skewed to the web stock so that the slit paper web sections twist as they slide over the leading edges of the web deflector. The web twists cause the split web sections to flow toward the centerline of the original web stock. At least two tension devices downstream of the web deflector in the web path cause the split web sections to move in loops from the web deflector towards a burster device. These loops merge such that the split web sections substantially overlap at the bottom of the loops. The burster receives the split web sections in a substantially superimposed arrangement one over the other.

In another embodiment, the invention is an interstacking web deflector comprising a planar support plate having bracket plates mounted on either side of the plate. The plate has a substantially straight rear edge and a substantially triangular leading edge. The rear edge of the planar support plate is mounted adjacent an outlet device for longitudinally slit webs. The leading edges of the support plate are oriented such that the split webs flow downward over the triangular leading edges to twist split webs into a superimposed arrangement.

DESCRIPTION OF DRAWINGS

In the drawings accompanying and forming part of the specification.

DETAILED DESCRIPTION OF THE DRAWINGS

Figure 1:
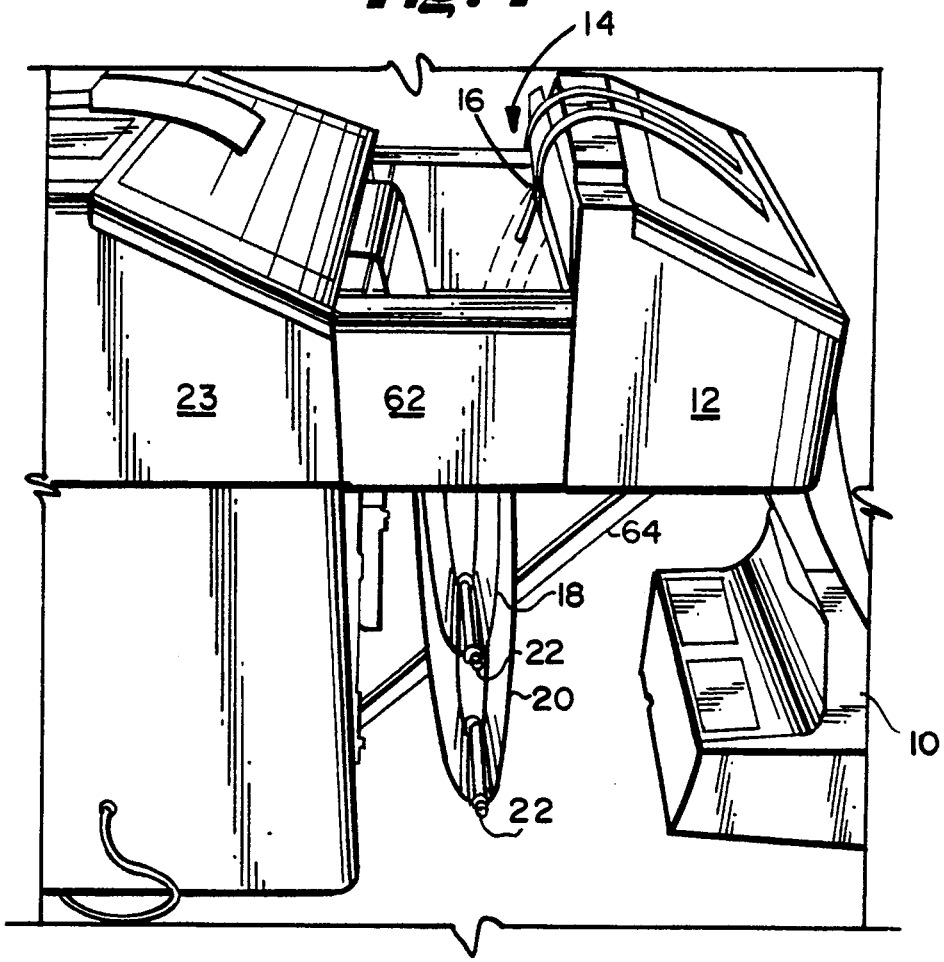
FIG. 1 shows a side perspective view of a paper handling apparatus employing an embodiment of the invention.

FIG. 1 shows a paper handling apparatus for splitting a single paper web 10 longitudinally into two paper webs. The split pair of paper webs are routed so that one half of the web overlies the other half and the two web halves are superimposed one over the other. The pair of superimposed split webs are aligned one over the other and brought together for further paper processing.

The stock paper web 10 is fed into a slitter merger device 12 that cuts the stock web longitudinally into left and right half webs. At the outlet 14 of the slitter merger is an interstacking web deflector 16. The slitter merger device is a conventional device such as that offered by assignee Moore under the model name 319A Interstacker. The interstacking web deflector, in one embodiment, is an attachment to the slitter merger.

The split webs are pulled downward over the triangular leading edges of the interstacking web deflector. The leading edges of the interstacking web deflector are angled in a triangular shape so that the right side of the split web is twisted at a slight angle to the left as the split web slides downward over the leading edge of the web deflector. Similarly, the left-side of the split web is twisted at an angle to the right.

The twists to the split web imparted by the interstacking web deflector causes the right and left web sides to separate and merge together, one side over the other. The left twist imparted in the right web section causes the right web section to move towards the center of the original stock web. Similarly, the right twist imparted to the left web section causes it to move towards the center of the original web stock.

In a relatively-short distance as the pair of split webs reach the bottom of their respective loops 18, 20, the split webs are in substantial superimposed alignment. At the bottom of each web loop is a web loop tension tube 22 that imparts a constant tension on each loop. In addition, the web loop tension tubes naturally impart a twist in their respective loops opposite to the twist imparted by the interstacking web deflector. Accordingly, as the web loops move upward from the tension tubes, the loops have no twist and are superimposed one over the other.

The web loops enter a conventional burster device 23 which superimposes the split webs one onto the other. The burster 23 continues processing of the superimposed web loops. For example, the superimposed webs can be made into multiply business forms or other products. The burster is a conventional device such as that offered by assignee Moore as model 3400 Continuous Forms Detacher.

Figure 2:
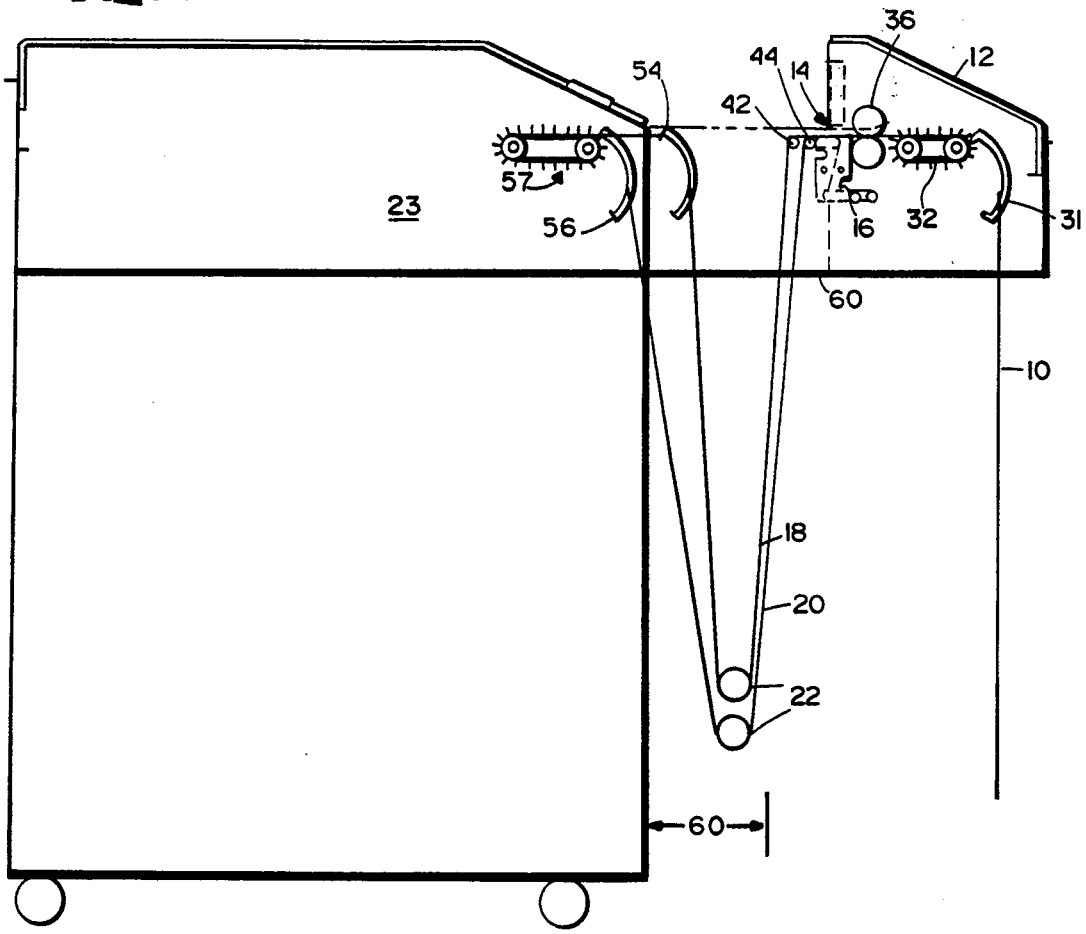
FIG. 2 is a side-view schematic diagram of the paper handling apparatus shown in FIG. 1 showing the paper path through the apparatus.

FIG. 2 shows in greater detail the flow of the paper web through the slitter merger, the loop tension tubes and into the burster. The original stock web 10 enters a tractor feed guide 31 and subsequently a tractor feed 32 of the slitter merger 12. This tractor feed engages the columns of tractor feed holes 34 (FIG. 3) in the margin of both sides of the original stock web.

Figure 3:
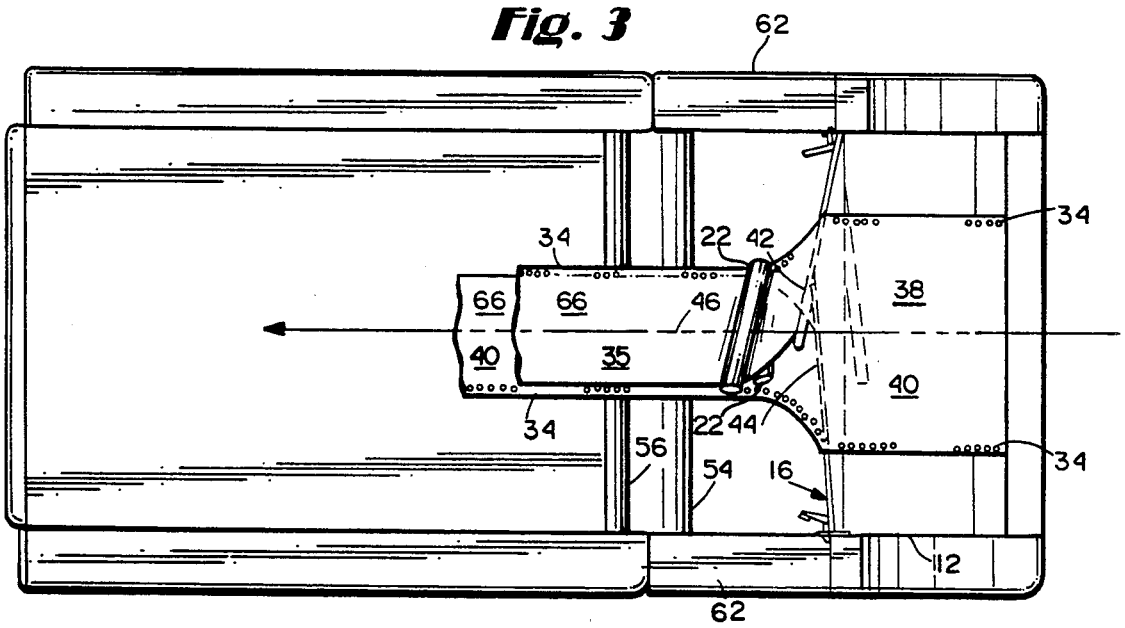
FIG. 3 is a top view of FIG. 2.

The stock paper web 10 moves horizontally through the slitter merger through the slitter wheels 36. The slitter wheels are rotating cutter wheels having sharp paper cutting edges. The wheels are above and below the stock web, and cut the stock web longitudinally into a right-hand web 38 and a left-hand web 40 (FIG. 3). Upon passing between the slitter wheels, the right-hand and left-hand webs remain side-by-side moving in parallel.

Upon passing through the outlet 14 of the slitter merger device, the right-hand and left-hand split webs pass over the interstacking web deflector 16. The leading edges of the interstacking web deflector are formed by a pair of rods 42, 44 that intersect at an oblique angle to form a triangular leading edge. The angles that the rods 42, 44 form with respect to the web impart twists to the left-hand and right-hand web sections 40, 38, as the sections pass downward over the edge of the web deflector. As shown in FIG. 3, the twists in each web section cause the sections to deflect towards the centerline 46 of the stock web 10.

Figure 4:
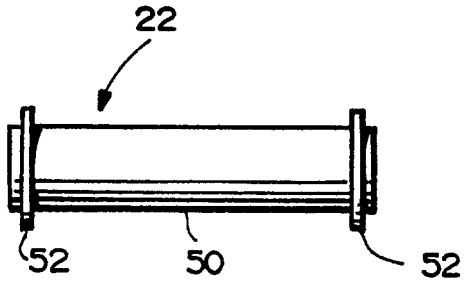
FIG. 4 shows in detail a web tension device for use with the embodiment shown in FIG. 1.

The webs are pulled downward from the interstacking web deflector 16 by the web loop tension tubes 22. As shown in FIG. 4, the web loop tension tubes 22 each comprise a weighted, cylindrical roller 50 having annular flange edge guides 52 on either end of the tension tube 50. The tubes 50 have a smooth surface that does not scrape or tear the webs. The web tubes are weighted to pull their respective web loops 18, 20 downward across the leading edges of the interstacking web deflector 16 at constant levels of tension. The web loop tension tubes are supported solely by the web loops and are free to orient themselves with respect to the twists in the left-hand and right-hand web sections.

As the loops 18 and 20 pass under the rotating web loop tension tubes, the loops flow upward toward the tractor feed guides 54, 56 on the burster 23. These tractor feed guides are perpendicular to and aligned with the centerline 46 of the web stock. To properly engage these burster tractor feed guides, the right and left split web sections must also be aligned with centerline 46. This requires that the web sections be superimposed and untwisted.

To orient the paper web sections along the centerline 46 of the original web stock and remove the twist sections, the web loop tension tubes 22 impart a twist in the right-hand and left-hand web sections 38, 40 equal but opposite to the twist angle imparted to the web sections by leading edges of the interstacking web deflector (FIG. 3). Because the web loop tension tubes are supported solely by the web loops, the tubes are free to orient themselves to remove the twist imparted to the left and right-hand webs by the interstacking web deflector. The tubes tend to be oriented parallel to the edge of the web deflector over which passed the respective web sections. This orientation naturally untwists the web loops.

As shown in FIGS. 2 and 3, the gap 60 between the slitter merger 12 and the burster 23 is relatively narrow as compared to the gaps required in prior art devices, In a preferred embodiment, this gap is a mere five or six inches between the slitter merger and burster. The slitter merger 12 is supported and attached to the burster 23 by a pair of side walls 62 between the burster and slitter merger. In addition, a support brace 64 (FIG. 1) extends upwardly from the burster at an angle to the bottom of the slitter merger to support the slitter merger.

As the left-hand 40 and right-hand 38 web sections enter the burster from their respective loops 20, 18, the sections are superimposed one over the other so that the main sheet sections 66 of the two web sections are superimposed one over the other. The left-hand and right-hand web sections have respectively a single marginal column of tractor feed holes 34 that engage the tractor feed guides 54, 56, respectively, and subsequently a tractor feed 57 of the burster 23. Accordingly, the tractor feed holes margin 34 in the web do not overlap.

Figure 5:
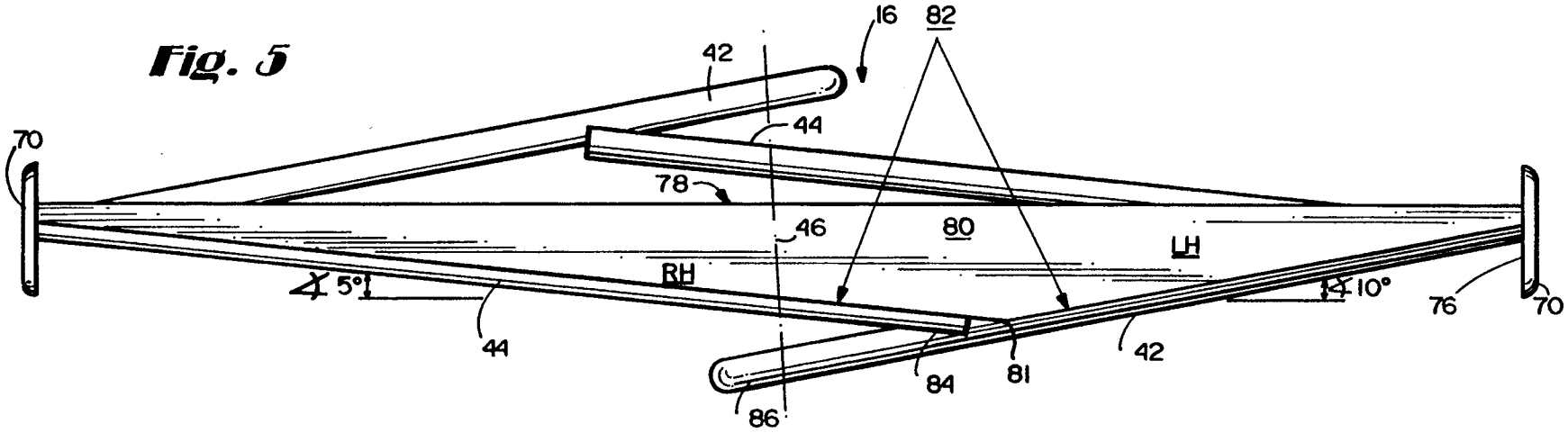
FIG. 5 is a top view of one embodiment of an interstacking web deflector.
Figure 6:
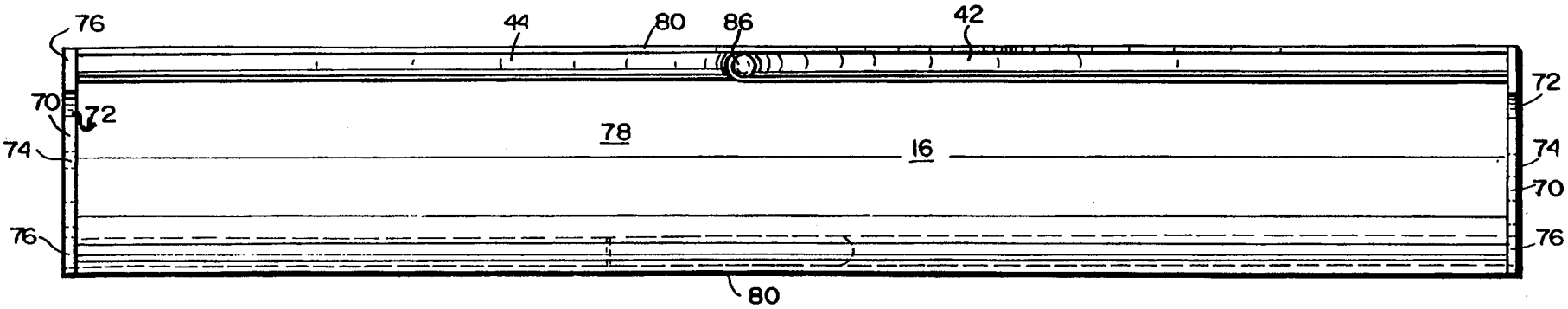
FIG. 6 is a front view of the embodiment shown in FIG. 5.

FIGS. 5 through 6 show in detail the intersecting web deflector 16. The leading edges of the deflector are formed by pairs of steep and shallow rods 42, 44 that are welded at their outer ends to end brackets 70. Each bracket 70 is a rectangular metallic plate having slots 72 and alignment mounting holes 74. The end brackets provide structural support for the steep and shallow rods and attach to the slitter merger 12. The holes 74 in the brackets fit into corresponding pins on the slitter merger and the slots 72 in the bracket engage screws in the slitter merger that hold the brackets and web deflector in place against the outlet 14 of the slitter merger.

Shallow angled depressions 76 on the inside surface of the bracket plates receive the ends of the steep and shallow rods. The steep and shallow rods are welded in place in these depressions near the top and bottom of the bracket plates. The steep rod 42 is welded to the bracket at an angle of approximately 80° to the plane of the bracket. Similarly, the shallow rod 44 forms an angle of approximately 85° with respect to the plane of the bracket 70. The particular angle of the rods will depend on the intended application for the web deflector.

Figure 7:
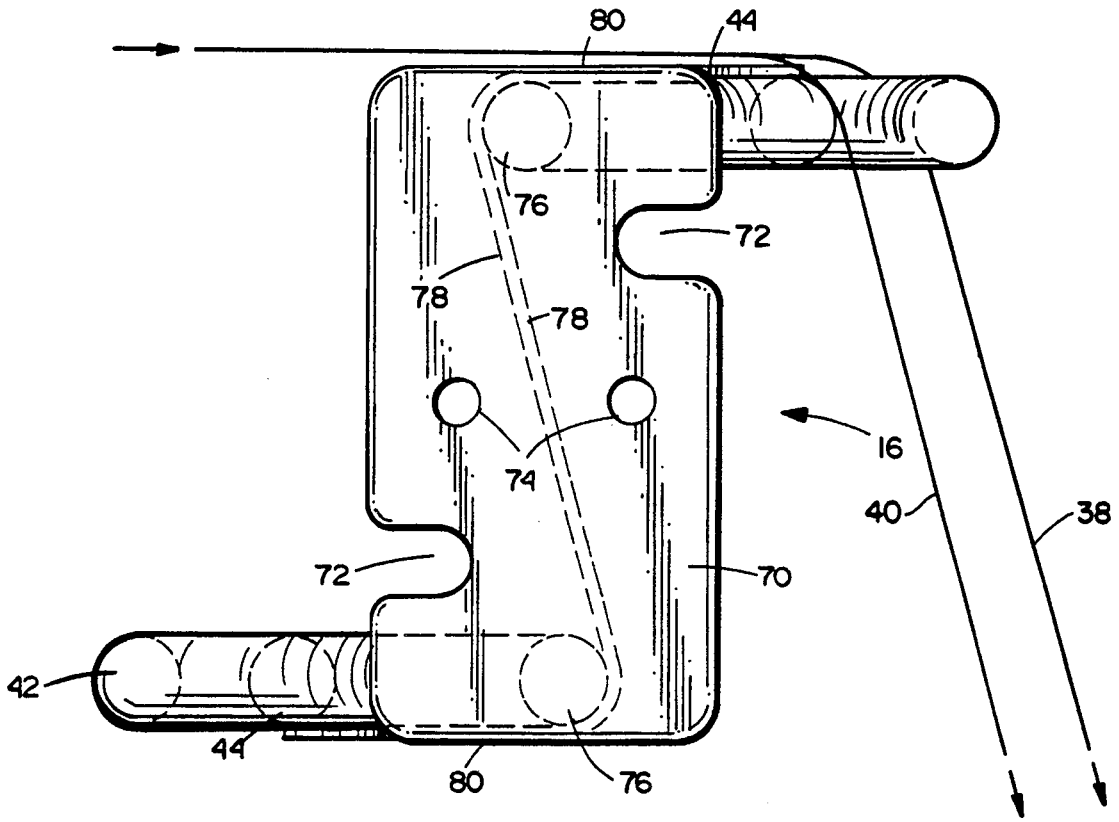
FIG. 7 is a side view of the embodiment shown in FIG. 5.

The form support plate 78 is Z-shaped in cross section as is shown in FIG. 7. The form support plate connects the bracket plates 70 pair together and supports the rods 42, 44. The brackets 70 are welded to the opposite ends of the form support plate. The top 80 of the support plate has a triangular planar shape. The rear straight edge of the top 80 of the form support plate is aligned horizontally with the outlet 14 to the slitter merger as is shown in FIG. 2. This alignment allows the paper webs passing through the slitter merger outlet to flow smoothly over the top 80 of the support plate 78 of the interstacking web deflector 16.

The apex 81 of the triangular top 80 (and bottom) is displaced off centerline 46 towards the steep rod 42 side of web deflector. The leading edges 82 of the form support plate extend at angles from the apex back to the plate brackets 70 as is shown FIG. 5. Immediately underneath the leading edges of the form support plate are welded the steep and shallow rods 42, 44. The junction of the leading edge of the form support plate, and steep and shallow rods is smooth to avoid scraping or tearing the webs of paper.

The split left-hand and right-hand paper webs 38, 40 flow downward over the triangular leading edges 82 and associated rods 42, 44 of the interstacking web deflector 16. In the orientation shown in FIG. 5, the right-hand (RH) side of the web deflector has a leading edge that has a shallower angle (with respect to the back edge of the top 80) than does the leading edge for the left-hand (LH) side of the web deflector. The web sections fold over these edges at the angles of the edges.

The shallow rod 44 is welded into a notch 84 in the steep rod 42. The steep and shallow rods are horizontally mounted in the same plane, as shown in FIG. 6. In this horizontal plane, the shallow rod 44 is oriented to be slightly upstream to the paper web path with respect to the steep rod. This orientation allows the web section passing over the steep rod 42 to form a loop 18 within the loop 20 formed by the web passing over the shallow rod 44. In addition, the end of the steep rod 86 extends over a portion of the shallow rod 44 in the horizontal plane.

In operation, as the right-hand web 38 folds over the shallow rod 44 and right-hand edge of the web deflector, the right-hand web is angled a few degrees, e.g. 5°, off the centerline 46 of the stock web. This angle imparts a twist in the right-hand web that causes the right-hand web to flow towards the centerline 46 of the web stock as the web moves down to the tension tube 22 (FIG. 2). Similarly, the left-hand web is flows downward over the LH leading edge and steep rod 42 of the web deflector. The angle of the steep rod also imparts a twist, e.g. 10°, in the left-hand web 40. This twist also causes the left-hand web to flow towards the centerline 46.

The angle that the steep rod 42 makes with the centerline is approximately double the angle that made by the shallow rod. This difference in angles allows the web sections to merge one over the other as the web sections move to the bottom of their respective loops 18, 20. The difference in the angles of the steep and shallow rods causes the amount of twist imparted to the left-hand web to be approximately double the twist imparted to the right-hand web. The twists in the web sections are removed before the web sections reach the burster. The web twists are removed by the free-floating roller tension tubes at the bottom of the web loops 18, 20. At the bottom of the web loops where the tension rods are positioned, the left-hand and right-hand web sections substantially overlap. As the web sections flow upwards from the tubes towards the burster, both webs are in alignment with the centerline 46 of the original web stock and enter the burster guide vanes and tractor feeder in proper alignment and with minimal difficulty in jamming and tearing.

As shown in FIG. 7, the interstacking web deflector 16 is reversible top to bottom. The deflector can be mounted on the merger slitter with the top 80 as shown in FIG. 5 so that the left-hand web is superimposed over the right-hand web. If it is desired to have the right-hand web overlap the left-hand web, then the web deflector is inverted.

The invention has been described in conjunction with its preferred embodiment. However, the invention is not limited to this preferred embodiment. The invention is as broad as that provided by the spirit and scope of the appended claims.

What I claim is:

1. A web handling device comprising:

web splitter cutting a moving web along a centerline into at least two split web sections;

web deflector downstream of said moving web and receiving said split web sections, said web deflector having a first and second elements, said deflector having a first position wherein said first element displaces a right web section of said split web sections over a left web section of said split web sections, and said deflector having a second position wherein said second element displaces the left web section over the right web section;

tension device receiving said split web sections downstream from said web deflector, said split web sections being substantially superimposed when received by said tension device, said tension device comprising first and second web guide surfaces oriented to untwist said split web sections, and web processing device receiving said split sections downstream of said tension device.

2. A web handling device as in claim 1 wherein said first and second elements of said web deflector each comprise a triangular leading edge wherein the left web section passes over a first leg of said triangular leading edge and the right web section passes over a second leg of said triangular leading edge, said first element having a triangular leading edge apex offset from said centerline in one direction and said second element having a triangular leading edge apex offset from the centerline in an opposite direction.

3. A web handling device comprising:

a web splitter cutting a moving web along a centerline into at least two split web sections;

a web deflector downstream of said moving web and receiving said split web sections, said web deflector having a first pair of leading edges oblique to said centerline, said leading edges twisting said split web sections as the sections pass over said edges;

a tension device receiving said split web sections downstream from said web deflector, said split web sections being substantially superimposed when received by said tension device, said tension device comprising first and second web guide surfaces oblique to one another and to said centerline, and said first and second web guide surfaces oriented to untwist said split web sections, and a web processing device receiving said split sections downstream of said tension device.

4. A web handling device as in claim 3 wherein said at least two leading edges of said web deflector are substantially straight and one of said leading edges forms an angle to said moving web approximately double the angle formed by a second of said leading edges.

5. A web handling device as in claim 3 wherein said at least two leading edges of the web deflector are formed by intersecting rods.

6. A web handling device as in claim 3 wherein said web deflector further comprises a triangular support plate having said leading edges, the apex of said triangular support plate being displace towards a side of said web deflector.

7. A web handling device as in claim 3 wherein said tension device comprises at least two tension tubes each supported by a respective loop formed by said split web sections.

8. A web handling apparatus comprising:

a slitter merger receiving a web stock and slitting the web into longitudinal sections, said slitter merger having an outlet from which slit sections of said web emerge;

an interstacking web deflector adjacent said outlet and having leading edges, said leading edges skewed said web stock, said slit paper webs flowing over said leading edges twists such that said slit sections to flow toward the centerline of said web stock;

at least two tension devices downstream in the web path from said web deflector, said tension devices causing said slit sections to flow in a loop from said web deflector, a loop from one said slit section substantially overlapping a second loop from a second slit section at the apex of said loops; and a burster receiving said slit sections of the paper web where said slit sections are substantially superimposed one over the other.

9. An interstacking web deflector comprising:

a planar support plate having bracket plates mounted on each side of said plate, said plate having a substantially straight rear edge and a substantially triangular leading edge, and said rear edge of said planar support plate being mounted adjacent an outlet device for longitudinally slit webs, said slit webs flowing downward over said leading edge.

10. An interstacking web deflector as in claim 9 wherein said substantially triangular leading edge having an apex displaced towards one side of said plate.

11. An interstacking web deflector as in claim 9 further comprising a pair of rods attached and parallel to said triangular leading edge, an end of one of said pair of rods extending outward from an apex of the triangular leading edge of said support plate.

* * * * *